US009567797B2

(12) United States Patent
Fitzpatrick

(10) Patent No.: US 9,567,797 B2
(45) Date of Patent: Feb. 14, 2017

(54) ADJUSTABLE-WIDTH FLEXIBLE STAIR BARRIER

(71) Applicant: Better Options, LLC, Milton, GA (US)

(72) Inventor: Janelle Fitzpatrick, Milton, GA (US)

(73) Assignee: Better Options, LLC, Milton, GA (US)

( * ) Notice: Subject to any disclaimer, the term of this patent is extended or adjusted under 35 U.S.C. 154(b) by 0 days.

(21) Appl. No.: 14/860,674

(22) Filed: Sep. 21, 2015

(65) Prior Publication Data

US 2016/0208548 A1 Jul. 21, 2016

Related U.S. Application Data

(63) Continuation-in-part of application No. 12/380,828, filed on Feb. 25, 2009, now Pat. No. 9,140,056.

(60) Provisional application No. 61/031,013, filed on Feb. 25, 2008.

(51) Int. Cl.

| | |
|---|---|
| ***A47H 13/00*** | (2006.01) |
| ***E06B 9/02*** | (2006.01) |
| ***E06B 9/06*** | (2006.01) |
| *E06B 9/00* | (2006.01) |

(52) U.S. Cl.

CPC ..... *E06B 9/02* (2013.01); *E06B 9/0692* (2013.01); *E06B 2009/002* (2013.01); *Y10T 16/558* (2015.01); *Y10T 24/2561* (2015.01)

(58) Field of Classification Search

CPC .... E06B 9/02; E06B 9/0692; E06B 2009/002; E01F 13/022

USPC ..... 160/368.1, 327, 354, 383, 387, 388, 389,160/390

See application file for complete search history.

(56) References Cited

U.S. PATENT DOCUMENTS

| | | | | | |
|---|---|---|---|---|---|
| 736,242 | A * | 8/1903 | Gable | E06B 9/52 | 160/102 |
| 832,335 | A * | 10/1906 | McDonald | E06B 9/13 | 160/264 |
| 4,787,174 | A * | 11/1988 | Brown | E06B 9/02 | 49/55 |
| 4,852,194 | A * | 8/1989 | Langan | A47D 15/005 | 256/23 |
| 5,437,115 | A * | 8/1995 | Freese | E06B 9/02 | 49/449 |

(Continued)

*Primary Examiner* — Katherine Mitchell
*Assistant Examiner* — Abe Massad
(74) *Attorney, Agent, or Firm* — Todd Partners, P.C.; Jack D. Todd

(57) ABSTRACT

An adjustable-width barricade for removable installation at the bottom of a staircase includes a flexible, frameless, planar, and generally-rectangular barrier member that extends between two posts on either side of the staircase. The barrier member is installed in a banister-to-banister configuration, a wall-to-banister configuration, or a wall-to-wall configuration. The barrier member has a front and back surface that forms an interior space therebetween. The adjustable-width barricade further includes a plurality of fasteners extending from one or both sides of the barrier member for tensioning engagement between one or both posts that maintains the lateral or horizontal integrity of the barricade. A plurality of rigid, structural support members are removably insertable in vertical channels within the interior space of the barrier member to provide vertical structural support when the barricade is installed across the bottom of the staircase or, alternatively, when the barricade in in a rolled-up stowed configuration.

17 Claims, 12 Drawing Sheets

(56) References Cited

U.S. PATENT DOCUMENTS

| | | | | | |
|---|---|---|---|---|---|
| 5,460,409 | A * | 10/1995 | Conner | B60R 21/06 | 160/327 |
| 5,531,258 | A * | 7/1996 | Poulson | E06B 9/02 | 160/371 |
| 5,533,715 | A * | 7/1996 | Dandrea | E01F 13/022 | 160/351 |
| 5,617,674 | A * | 4/1997 | Terrill | E06B 9/02 | 49/465 |
| 6,470,948 | B2 * | 10/2002 | Yates | E06B 9/0692 | 160/35 |
| 7,178,792 | B2 * | 2/2007 | Monahan | E06B 9/08 | 160/10 |
| 2001/0015266 | A1 * | 8/2001 | Yates | E06B 9/0692 | 160/84.06 |
| 2006/0042163 | A1 * | 3/2006 | Nitz | E06B 9/04 | 49/55 |
| 2006/0180284 | A1 * | 8/2006 | Wiggins | E06B 9/02 | 160/368.1 |

* cited by examiner

ADJUSTABLE-WIDTH FLEXIBLE STAIR BARRIER

CROSS-REFERENCE TO RELATED APPLICATIONS

This application is a continuation-in-part (CIP) of and claims priority benefit under 35 U.S.C. §120 to U.S. patent application Ser. No. 12/380,828, filed Feb. 25, 2009, now U.S. Pat. No. 9,140,056, issued Sep. 22, 2015, entitled "Adjustable Width Stairwell Barricade," which claims priority benefit under 35 U.S.C. §119(e) to U.S. Provisional Patent Application No. 61/031,013, filed Feb. 25, 2008, entitled "Adjustable Width Stairwell Safety Gate," both of which are hereby incorporated by reference in their entirety as if set forth in full herein.

FIELD OF THE INVENTION

The present invention relates generally to stairwell barriers and, more particularly, to an adjustable-width stairwell barrier comprised of a planar, frameless, horizontally-flexible but vertically-rigid barrier that can be easily, securely, and removably installed at the bottom of any one of a plurality of stairwells having a wide range of possible widths and intended to prevent children and pets from going up the stairs.

BACKGROUND OF THE INVENTION

Most conventional child safety gates are constructed with an inflexible outer frame structure having rigid horizontal and vertical members to support the rigid, structural integrity of such frame. Since safety is the primary concern and purpose of such child safety gates, ease of installation, potential damage caused to walls, banisters, and railings, and aesthetic appearance are all secondary considerations that are often sacrificed. Conventional rigid-framed gates are often difficult to install and equally difficult to disassemble and remove or relocate. Furthermore, conventional rigid-framed gates require drilling into the walls and wooden banisters, or in the alternative, require tedious assembly of clumsy wooden or plastic faceplates that are then hinged to the existing stairway rails as a means of attaching the safety gate. Furthermore, conventional rigid-framed child safety gates are not easily installed or used at the bottom of stairwells—particularly stairwells having custom decorative stairway posts, banisters, or balusters, which typically have vertically varying diameters and configurations, are non-parallel relative to each other, are non-perpendicular relative to flooring surface or are otherwise asymmetrical, or are very wide (i.e., horizontally-spaced apart at the bottom of the stairs). Typical child safety gates often leave large gaps between the safety gate and the stairway railing in which a small child may become trapped or wedged while attempting to wiggle through such a gap.

A number of US patents and applications have been issued or published in the art of child safety barriers. For example:

(a) U.S. Pat. No. 4,852,194, entitled "Safety Barrier for Small Children," issued to Jeffrey M. Langan on Aug. 1, 1989, discloses a barrier or safety guard for preventing the escape of small children from a safe area, having as its basic element a panel of flexible material, preferably in the form of netting with relatively small apertures therein. A border of flexible material is provided for the periphery of the panel and has a plurality of spaced openings around the entire periphery of the panel. These openings are provided with grommets and a plurality of ties or laces by which the borders of the panel can be fastened to points on the supporting structure. The panel can be folded in either or both dimensions to adjust its size to smaller dimensions. Small sub-panels can be used to prevent the main panel from being dislodged.

(b) U.S. Pat. No. 5,617,674, entitled "Adjustable Passage Gate," issued to Timothy T. Terril on Apr. 8, 1997, discloses an adjustable passageway gate that includes a thin generally rectangular-parallelepiped-shaped panel, a large, extendable, retractable, and generally rectangular-parallelepiped-shaped extension member, a pair of small, spaced-apart, extendable, retractable, and generally rectangular-parallelepiped-shaped extension members, an elongated and generally rectangular-parallelepiped-shaped cross member, and a bolt. The thin generally rectangular-parallelepiped-shaped panel is positioned on one side of a wall. The large, extendable, retractable, and generally rectangular-parallelepiped-shaped extension member and the pair of small, spaced-apart, extendable, retractable, and generally rectangular-parallelepiped-shaped extension members are extendable to contact the wall when the passageway of the wall is wider than the thin generally rectangular-parallelepiped-shaped panel.

(c) U.S. Pat. No. 6,470,948, entitled "Safety Gate," issued to Robert Yates on Oct. 19, 2002, discloses a collapsible, child safety gate for selectively forming a barrier across an opening inside a house such as a stairwell, and includes a storage housing capable of being fixed in position across the house opening, either permanently or temporarily and a folding curtain, which can be stored in the storage housing when folded and which can be withdrawn therefrom along guide tracks to an extended position for forming a barrier across the opening.

U.S. Pat. No. 4,787,174, entitled "Child Safety Gate," issued to Tyrone Brown on Nov. 28, 1988, discloses a sturdy, effective, and economical portable barrier designed safely to restrain and protect babies, toddlers, and pets. The safety barrier comprises spring-biased decorative panels, which expand to securely engage a door frame and contract to a compact compressed position.

U.S. Patent Publication No. US 2006/0042163 A1, entitled "Baby Gate," filed by Allen S. Nitz on Aug. 27, 2004, discloses a gate assembly for selectively opening and closing a passageway and includes opposed sides defined by a pair of newel posts. The gate assembly includes a gate, first and second mounting assemblies, and a pair of hinges. Each mounting assembly includes a mount face plate, a backing plate, and a plurality of fasteners for mounting the face plate to one of the posts. The hinges define a hinge axis and couple the gate to the first mounting assembly face plate and permit pivotal movement of the gate about the hinge axis between first and second open positions and through a closed position through an arc of about 270 degrees. The gate is substantially parallel to the face plate when in the closed position. A caster wheel is coupled with the bottom of the gate in order to facilitate pivotal movement of the gate and to inhibit undesired forces on the hinges.

U.S. Patent Publication No. US 2006/0180284 A1, entitled "Child Safety Gate," filed by Katherine Wiggins on Feb. 15, 2005, discloses a child safety gate comprised of a rigid frame structure including a pair of transversely spaced rigid upright frame legs and an intermediate leg positioned at right angles to the upright frame legs, a flexible gate member having means securing the gate member in unitary assembly with the rigid frame structure, and a pair of flexible strap-like adjustable hinges secured to the transversely spaced rigid upright frame legs for securing the flexible adjustable foldable hinges to stairway posts. Each of the flexible adjustable hinges is comprised of a flexible top strip piece having a cushioned non-slip fabric layer secured on an inside surface and each of the strip pieces and the cushioned non-slip fabric layer are sized, shaped and positioned for assembled contact with upright stairway posts to present slipping of the straps; thereby, keeping the gate firmly position and to avoid scratching of the upright stairway posts when attached to the upright stairway posts.

U.S. Pat. No. 7,178,792, entitled "Child Safety Barriers," issued to Robert D. Monahan on Feb. 20, 2007, discloses a child safety gate including a flexible barrier that is retractable into a housing and extendable across a passageway to inhibit passage by a child. An electrically operable extension lock solenoid inhibits barrier extension until activated by a parent. The gate includes a motion sensor, a night light, a child monitor, and an interactive audio-visual display.

U.S. Pat. No. 5,437,115, entitled "Security Gate Apparatus," issued to T. Brent Freese on Aug. 1, 1995, discloses a security gate apparatus for attachment across an opening defined by first and second vertical surfaces, including a first gate panel and a second gate panel slidingly connected to the first gate panel so as to permit horizontal extension and retraction of the gate apparatus to a desired horizontal dimension. A first vertical leg is pivotably attached to an outer vertical member of the first gate panel by a first link means and a second vertical leg is pivotably connected to an outer vertical member of the second gate panel by a second link means. The security gate apparatus also includes means for locking the first and second gate panels in the desired horizontal dimension and at least one contact pad on a surface of the first and second vertical legs opposite the outer vertical members of the first and second gate panels, respectively.

U.S. Pat. No. 5,531,258, entitled "Folding Soft Gate," issued to Keith L. Poulson on Jul. 2, 1996, discloses a security gate for positioning within an area way such as a doorway. The gate includes a support structure defined by a frame and a flexible panel supported by the frame. The frame includes horizontal members and vertical members wherein the vertical members may be conveniently folded to a position parallel to the horizontal members whereby the gate is folded to a compact configuration for transportation or storage.

While these patents and published applications teach the general concept of barricades or gates used to contain children and small pets within a room or off stairs, they do not teach a frameless, adjustable-width, horizontally-flexible but vertically-rigid barrier that can be easily, securely, and removably installed at the bottom of a stair case or stair well from banister to banister or wall to banister without damaging either the structural integrity or decorative finish of ornamentally designed wooden banisters, balusters, rails, or posts.

Although conventional gates may be somewhat satisfactory in preventing the ingress and egress of small children and pets through doorways and onto stairway passages, particularly at the top of a stairway, there remains is a tremendous need for an adjustable-width stairwell barrier comprised of a planar, frameless, horizontally-flexible but vertically-rigid barrier that can be easily, securely, and removably installed at the bottom of any one of a plurality of stairwells having a wide range of possible widths and intended to prevent children and pets from going up the stairs. There is a need for such a barrier that is visually attractive and aesthetically pleasing—particularly in modern, elegant homes having high-end, custom stairway posts, spindles, balusters, and banisters. There is a need for such a barrier that is capable of widening and selectively expanding to fit securely across a variety of stairwell configurations, particularly from banister to banister or wall to banister. Additionally, there is a need for such a flexible barrier that will not damage the stairway posts, balusters, spindles, and banisters. Furthermore, there is a need for a stair barrier that can attached between banisters or from a wall to a banister in which the banister or post has a variable size or shape as it extends from the floor to the railing (e.g., hand rail), when the stair barrier needs to extend across the bottom of the stairs in an angled or asymmetrical manner, or such that the bottom of the barrier is not parallel to the flooring surface. Furthermore, there is a need for an improved flexible stair barrier that can be customized in style and appearance and that has the practical attribute of being washable, easy to remove, and easy to transport or carry to different locations.

The present invention provides a non-obvious solution to all of the above problems and challenges.

Further advantages of the methods and systems described herein will become apparent to one of skill in the art after reviewing the remainder of the present application with reference to the drawings and detailed description which follows.

SUMMARY OF THE INVENTION

According to the present invention, there is provided an improved adjustable-width stairwell barrier comprised of a planar, frameless, horizontally-flexible but vertically-rigid barrier that can be easily, securely, and removably installed at the bottom of any one of a plurality of stairwells having a wide range of possible widths and intended to prevent children and pets from going up the stairs.

In one aspect of the present invention, an adjustable-width barrier for removable installation between respective posts of opposed banisters of a stairwell, the respective posts having a vertical height and being a fixed horizontal distance across the stairwell from each other, comprises a planar, frameless, flexible, and generally-rectangular gate member having a width extending between each side edge of the gate member and a height extending between a top edge and a bottom edge of the gate member, the width, when fully expanded, being substantially equal to or greater than the fixed horizontal distance between the respective posts and the height being substantially equal to or less than the vertical height of the respective posts, a first plurality of fasteners attached to the gate member, the first plurality of fasteners vertically spaced along and extending from one side edge of the gate member, each fastener having two straps adapted to engage in locking manner around one of the respective posts, a second plurality of fasteners attached to the gate member, the second plurality of fasteners vertically spaced along and extending from the other side edge of the gate member, each fastener having two straps adapted to engage in locking manner around the other of the respective posts, one of the two straps of each of the first plurality of fasteners on one side edge of the gate member connected with one of the two straps of a corresponding one of the second plurality of fasteners disposed at the same vertical location on the other side edge of the gate member, each of the connected straps defining an adjustable length strap that extends laterally within the gate member between the side edges, and a plurality of rigid, structural support members, each structural support member inserted within a respective vertical channel extending between the top edge and the bottom edge of the gate member, each of the vertical channels transversely spaced along the width of the gate member wherein the height of the gate member is rigidly maintained in non-compressible form by the structural support members inserted within the respective vertical channels, when inserted within the vertical channels, the plurality of rigid, structural support members provide vertical rigidity along the height of the gate member, and wherein, when the gate member is installed between the respective posts using the first and second plurality of fasteners, the width of the gate member is contracted to match the horizontal distance between the respective posts while simultaneously the gate member is maintained in lateral tension between the respective posts of the stairwell by tightening one or more of the adjustable length straps extending between the first and second plurality of fasteners.

In a feature, the first and second plurality of fasteners each include a respective top fastener extending from its respective side edge near the top edge of the gate member and a respective bottom fastener extending from its respective side edge near the bottom edge of the gate member. Preferably, the first and second plurality of fasteners each include at least one respective middle fastener extending from its respective side edge between the top and bottom edges of the gate member. Also preferably, the first and second plurality of fasteners are equally, vertically spaced along each side edge of the gate member.

In another feature, each end of the two straps of each respective fastener are adapted to engage in a releasable, locking manner. Preferably, each respective fastener is chosen from one of the following: a loop type fastener, a buckle, a snap type fastener, and a hook and eye type fastener.

In another feature, a portion of each respective fastener includes a surface for non-slip or non-damaging engagement with the respective post of the stairwell.

In yet a further feature, each of the plurality of rigid, structural support members is removable from the respective vertical channel. Preferably, the vertical channels comprise a first outer channel disposed in parallel to and proximate the one side edge of the gate member and a second outer channel disposed in parallel to and proximate the other side edge of the gate member. In another feature, the vertical channels comprise an interior channel disposed in parallel to and between the first and second outer channels. Preferably, the vertical channels are equally, laterally-spaced from each other along the width of the gate member. The number of vertical channels is variable, but will typically be based on the size and width of the gate member and the anticipated width between the respective posts of the stairwell with which the adjustable-width barrier in intended to be used. The number of vertical channels will typically be two or more.

In another feature, the adjustable-width barrier is partially removable from between the respective posts of opposed banisters of the stairwell by disengaging the first plurality of fasteners from one of the respective posts and manually rolling up the planar, frameless, flexible gate member toward the other of the respective posts.

In a second aspect of the present invention, an adjustable-width barricade for removable installation between respective posts of opposed banisters of a stairwell, the respective posts having a vertical height and being positioned a fixed horizontal distance across the stairwell from each other, comprises: a flexible, frameless, and generally-rectangular barrier member having a height extending between a top edge and a bottom edge of the barrier member and a width extending between each side edge of the barrier member, the height being substantially equal to or less than the vertical height of the respective posts and, when fully expanded, the width being substantially equal to or greater than the fixed horizontal distance between the respective posts, a plurality of fasteners vertically spaced along the height of the barrier member, one end of each of the plurality of fasteners extending from one side edge of the barrier member and the other end of each of the plurality of fasteners extending from the other side edge of the barrier member, each end having two straps adapted to engage in locking manner around one of the respective posts, each of the plurality of fasteners further having an adjustable length strap extending laterally and internally within the barrier member between the two respective ends, and a plurality of rigid, structural support members, each structural support member inserted within a respective vertical channel extending between the top edge and the bottom edge of the barrier member, each of the vertical channels laterally spaced along the width of the barrier member, wherein the height of the barrier member is rigidly maintained in non-compressible form along the width of the barrier member by the plurality of structural support members inserted within the respective vertical channels, wherein, when the barrier member is installed between the respective posts using the plurality of fasteners, by tightening at least one of the adjustable length straps of the plurality of fasteners, the width of the barrier member is contracted to match the horizontal distance between the respective posts while simultaneously applying and maintaining lateral tension to the barrier member between the respective posts.

In a feature, the straps are adapted to engage in locking manner around respective posts of varying size, style, and width.

In another feature, when properly installed, one of the adjustable length straps of the plurality of fasteners is tightened more than another of the adjustable length straps of the plurality of fasteners. Preferably, the amount of tightening of the one or more adjustable length straps of the plurality of fasteners is based in part on the size and shape of the respective posts around which the two straps of the corresponding fasteners engage.

In a further feature, the two straps of each respective fastener engage in locking manner around one of the respective posts using one of the following: a loop type fastener, a buckle, a snap type fastener, or a hook and eye type fastener. Preferably, a portion of the two straps of each respective fastener that engage in locking manner around one of the respective posts further include a surface (i) to prevent the two straps from slipping when in engagement with the respective posts and/or (ii) to prevent the two straps from damaging the respective posts when in engagement with the respective posts.

In another feature, the plurality of structural support members inserted within the respective vertical channels and the plurality of tightened adjustable length straps work cooperatively to maintain the barrier member in rigid and secure engagement between the respective posts.

In another aspect of the present invention, an adjustable-width barricade for removable installation at the bottom of a staircase, the staircase having a plurality of steps and at least one banister positioned on one side of the staircase, the banister including a handrail and a plurality of support posts each extending between a bottom surface of the handrail and a top surface of a respective one of the plurality of steps, comprising: a flexible, frameless, planar, and generally-rectangular barrier member having a fixed width main portion and at least one adjustable width side portion, the fixed width main portion having a mounting side edge and an opposed side edge connected to the at least one adjustable width side portion and forming a vertical junction line therebetween, the barrier member having a front surface and a back surface stitched together at least along a top edge and a bottom edge of the barrier member, the front and back surfaces defining an interior space therebetween, the barrier member having a fixed vertical height extending between the top edge and the bottom edge; a plurality of fasteners vertically spaced along the fixed vertical height of the barrier member, each of the plurality of fasteners having a pair of straps extending from a side edge of the at least one adjustable width side portion of the barrier member, the distal ends of each of the pair of straps configured to engage each other in releasable locking manner, the proximal end of one of the pair of straps connected to the side edge of the at least one adjustable width side portion, the proximal end of the other of the pair of straps extending laterally within the interior space and connected along the vertical junction line between the fixed width main portion and the at least one adjustable width side portion, the other of the pair of straps having an adjustable length; and a plurality of rigid, structural support members, each structural support member inserted within a respective vertical channel extending within the interior space and having an opening generally near the top edge of the barrier member and a closed end generally near the bottom edge of the barrier member, each of the vertical channels laterally spaced along the fixed width main portion of the barrier member, wherein the height of the barrier member is rigidly maintained in non-compressible form along the width of the barrier member by the plurality of structural support members inserted within the respective vertical channels; wherein, when the distal ends of each of the pair of straps are engaged with each other in releasable locking manner around at least one of the plurality of support posts and when the mounting side edge of the barrier member is installed on a post disposed laterally across the stairwell from the at least one of the plurality of support posts, the width of the barrier member is contracted or cinched to match the horizontal distance between the respective posts while simultaneously applying and maintaining lateral tension to the barrier member between the respective posts by tightening and adjusting the length of at least one of the plurality of fasteners engaged around the at least one of the plurality of support posts.

In a feature, the at least one of the plurality of support posts has a vertical height defined as the distance between the bottom surface of the handrail and the top surface of the respective one of the plurality of steps and wherein the fixed vertical height of the barrier member is substantially equal to or less than the vertical height of the at least one of the plurality of support posts. Preferably, the width of the barrier member is maintained in lateral tension between the respective posts by tightening and adjusting the length of two or more of the plurality of fasteners. In some embodiments, the circumference of the at least one of the plurality of support posts varies along its vertical height and the length of the two or more of the plurality of fasteners varies based on the respective circumference at the point at which each of the two or more of the plurality of fasteners engages the support post.

In another feature, the width of the barrier member is contracted, compressed, or cinched within the at least one adjustable width side portion of the barrier member. Preferably, the at least one adjustable width side portion of the barrier member is contracted, compressed, or cinched based on the tension applied between the proximal end of one of the pair of straps connected to the side edge of the at least one adjustable width side portion and the proximal end of the other of the pair of straps connected internally along the vertical junction line of the barrier member.

In yet a further feature, the mounting side edge of the barrier member includes a channel formed within the interior space of the barrier member, the channel receiving the post disposed laterally across the stairwell from the at least one of the plurality of support posts.

In another feature, the mounting side edge of the barrier member is connected to a second adjustable width side portion and forms a second vertical junction line therebetween and wherein the adjustable-width barricade further comprises a second plurality of fasteners vertically spaced along the fixed vertical height of the barrier member, each of the second plurality of fasteners having a pair of straps extending from a side edge of the second adjustable width side portion of the barrier member, the distal ends of each of the pair of straps configured to engage each other in releasable locking manner, the proximal end of one of the pair of straps connected to the side edge of the second adjustable width side portion, the proximal end of the other of the pair of straps extending laterally within the interior space and connected along the second vertical junction line between the fixed width main portion and the second adjustable width side portion, the other of the pair of straps having an adjustable length.

Preferably, the width of the barrier member is contracted, compressed, or cinched within the second adjustable width side portion of the barrier member. Yet further, the second adjustable width side portion of the barrier member is contracted, compressed, or cinched based on the tension applied between the proximal end of one of the pair of straps connected to the side edge of the second adjustable width side portion and the proximal end of the other of the pair of straps connected internally along the second vertical junction line of the barrier member.

In another feature, the post disposed laterally across the stairwell from the at least one of the plurality of support posts is a wall-mounted rod and the barricade is a wall-to-banister style barricade. Alternatively, the post disposed laterally across the stairwell from the at least one of the plurality of support posts is a post of a second banister positioned on the other side of the staircase and the barricade is a banister-to-banister style barricade.

In yet a further feature, the plurality of rigid, structural support members are accessible and removable through a slot on the back surface of the barrier member. The slot can be closed using a zipper or a Velcro-type closure. Preferably, the opening of each respective vertical channel is disposed below the slot on the back surface of the barrier member.

In another aspect of the present invention, an adjustable-width barricade for removable installation at the bottom of a staircase, the staircase having a plurality of steps and at least one banister positioned on one side of the staircase, the banister including a handrail and a plurality of support posts each extending between a bottom surface of the handrail and a top surface of a respective one of the plurality of steps, comprises: a flexible, frameless, planar, and generally-rectangular barrier member having a fixed width main portion and at least one adjustable width side portion, the fixed width main portion having a mounting side edge and an opposed side edge connected to the at least one adjustable width side portion and forming a vertical junction line therebetween, the barrier member having a front surface and a back surface joined together at least along a top edge and a bottom edge of the barrier member, the front and back surfaces defining an interior space therebetween, the barrier member having a fixed vertical height extending between the top edge and the bottom edge; a plurality of fasteners vertically spaced along the fixed vertical height of the barrier member, each of the plurality of fasteners having a pair of straps extending from a side edge of the at least one adjustable width side portion of the barrier member, the distal ends of each of the pair of straps configured to engage each other in releasable locking manner, the proximal end of one of the pair of straps connected to the side edge of the at least one adjustable width side portion, the proximal end of the other of the pair of straps extending laterally within the interior space and connected to the barrier member along the vertical junction line between the fixed width main portion and the at least one adjustable width side portion, the other of the pair of straps having an adjustable length; and a plurality of rigid, structural support members, each structural support member inserted within a respective vertical channel extending within the interior space and having an opening generally near the top edge of the barrier member and a closed end generally near the bottom edge of the barrier member, each of the vertical channels laterally spaced along the fixed width main portion of the barrier member, wherein the height of the barrier member is rigidly maintained in non-compressible form along the width of the barrier member by the plurality of structural support members inserted within the respective vertical channels; wherein the mounting side edge of the barrier member is installed on a post disposed laterally across the stairwell from a respective one of the plurality of support posts, a portion of the barrier member wraps around another respective one or more of the plurality of support posts, and the distal ends of each of the pair of straps are engaged with each other in releasable locking manner around a further respective one or more of the plurality of support posts, and wherein the barrier member is maintained in lateral tension across the stairwell by tightening and adjusting the length of at least one of the plurality of fasteners engaged around the further respective one or more of the plurality of support posts.

In a feature, the post disposed laterally across the stairwell from the respective one of the plurality of support posts is a wall-mounted rod and the barricade is a wall-to-banister style barricade. Alternatively, the post disposed laterally across the stairwell from the respective one of the plurality of support posts is a post of a second banister positioned on the other side of the staircase and wherein the barricade is a banister-to-banister style barricade.

These and other aspects, features and advantages of the invention will be understood with reference to the drawing figure and detailed description herein, and will be realized by means of the various elements and combinations particularly pointed out in the appended claims. It is to be understood that both the foregoing general description and the following brief description of the drawing and detailed description of the invention are exemplary and explanatory of preferred embodiments of the invention, and are not restrictive of the invention, as claimed.

BRIEF DESCRIPTION OF THE DRAWINGS

The present invention, as defined in the claims, can be better understood with reference to the following drawings. The components within the drawings are not necessarily drawn to scale relative to each other. On the contrary, the dimensions of the various features are arbitrarily expanded or reduced for clarity, emphasis instead being placed upon clearly illustrating the principles of the present invention. Like numerals denote like features throughout the specification and drawing.

DETAILED DESCRIPTION OF THE INVENTION

Although the invention has been described in terms of exemplary embodiments, the invention is not intended to be limited to the specific terminology so selected. Rather, it is to be understood that the appended claims should be construed broadly, to include all technical equivalents that operate in a similar manner to accomplish similar functions.

The preceding merely illustrates the principles of the invention. It will thus be appreciated that those skilled in the art will be able to devise various arrangements that, although not explicitly described or shown herein, embody the principles of the invention and are included within its spirit and scope. Furthermore, all examples and conditional language recited herein are primarily intended only to aid the reader in understanding the principles of the invention and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

Figure 1:
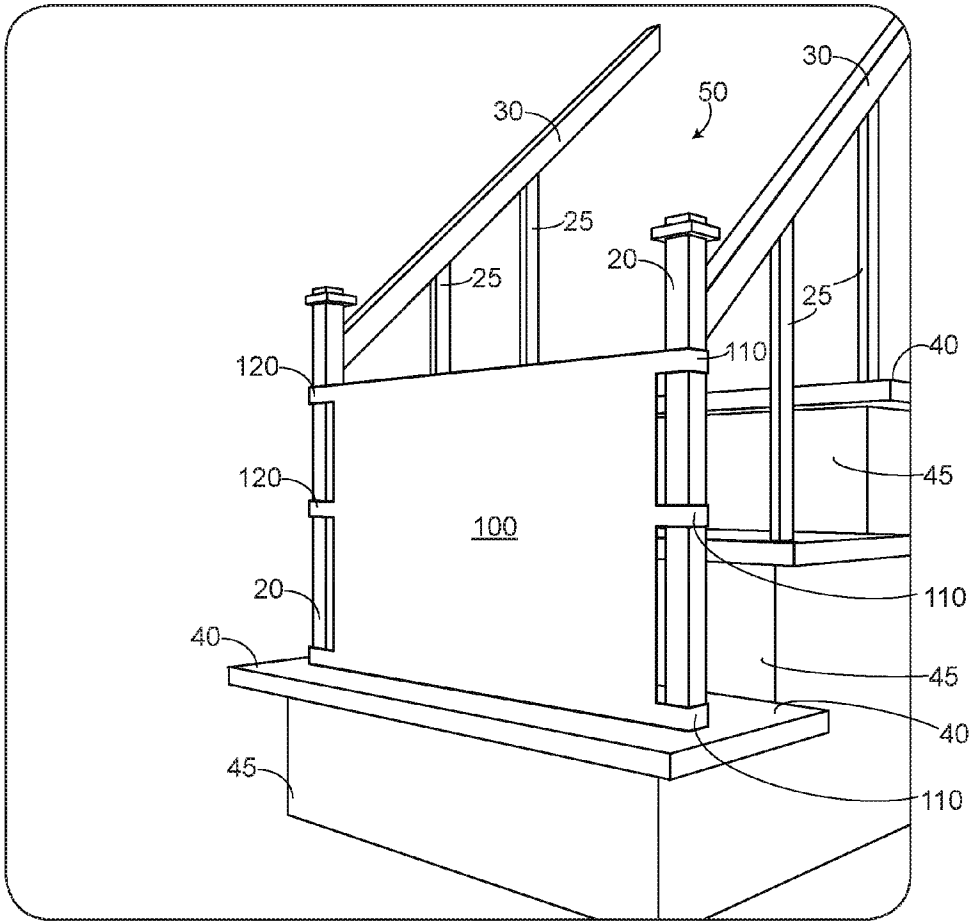
FIG. 1 illustrates a perspective view of an improved adjustable-width stairwell barricade according to the present invention.

Referring now to FIG. 1, a perspective view of one exemplary adjustable-width barrier or gate member 100 removably installed between opposed banisters 20 of a stairwell or staircase 50 is illustrated. A typical stairwell or staircase 50 includes banisters 20, spindles or balusters 25, hand rails 30 (if the staircase is open on both sides; and/or a wall rail (not shown) if the staircase has a wall on one or both sides and the rail is mounted directly to the wall rather than on the spindles/balusters 25), and stairs. The stairs are generally made up of a plurality of treads or steps 40 and risers 45.

As used herein, a banister 20 is generally used to describe the larger, usually more-decorative post at the bottom (or top) of the staircase that provides substantial support to one end of the hand rail 30. The spindles or balusters 25 generally describe the plurality of less-decorative posts, usually between the banister 20 at the bottom of the stairwell and the banister at the top of the stairs (not shown), which provide some support along the length of the hand rail 30 and provide some safety benefits along the open side(s) of the staircase. The term "banister" can also be used to describe the entire hand rail system that includes the hand-rail, each banister post, and all of the spindles. For this reason, the term "post" or "post of a banister" will be used generally herein to refer to any of the banisters, spindles, or balusters associated with a hand rail used in a stair case or stairwell. Each post has a vertical height that is defined as the distance extending from the location at which the post intersects with or extends out of the bottom surface of the hand rail 30 to the location at which the base of the post is mounted to or intersects with the surface of the stair tread 40 or the floor. For purposes of this disclosure and the appended claims, the floor is deemed to be the bottommost step or tread 40.

Typically, if the staircase is open on both sides, each post under one hand rail will have a corresponding post disposed at the same symmetrical location under the other hand rail. Each pair of corresponding posts will be disposed a horizontal distance across the stairwell from each other, although the distance may vary from one pair of posts to the next—particularly at the bottom of higher-end staircases in which the posts and hand rails tend to flair out further apart than the posts along the main and upper portions of the staircase. If the staircase has a wall on one side, each post under the hand rail side of the stair case will be disposed a horizontal distance from the wall and, usually, a slightly lesser distance at the bottom of the post relative to the stairwell molding.

Figure 2:
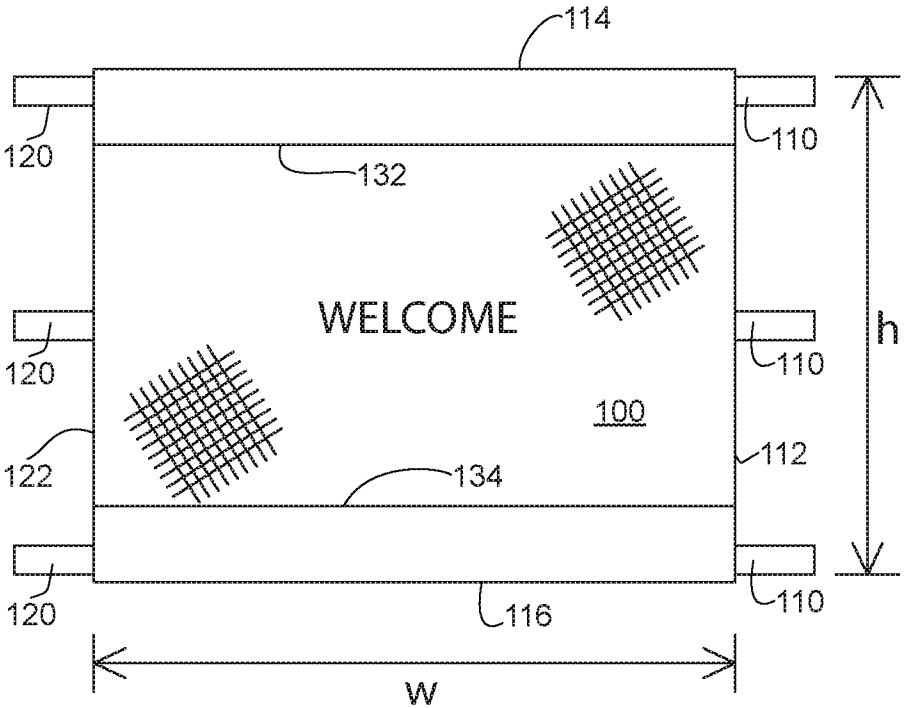
FIG. 2 illustrates a front, plan view of the improved adjustable-width stairwell barricade shown in FIG. 1.
Figure 3:
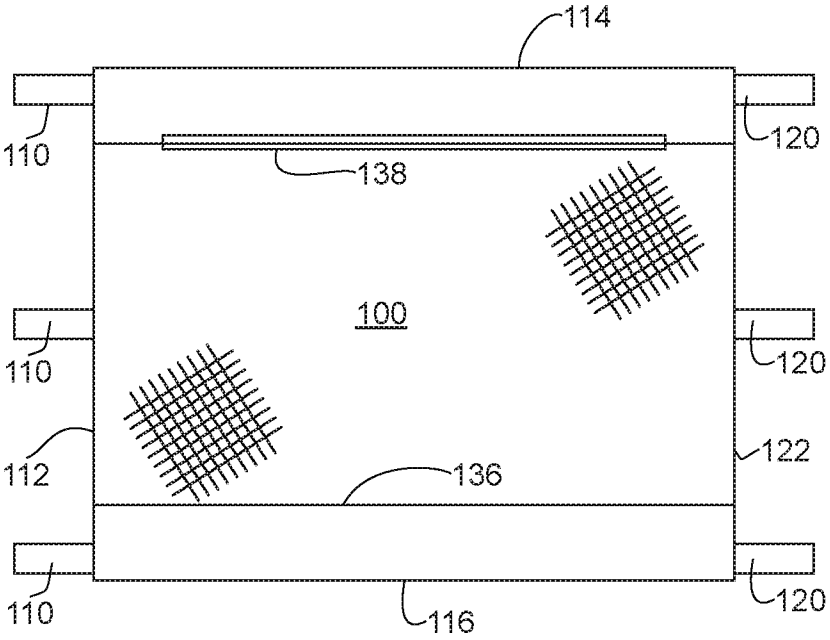
FIG. 3 illustrates a rear, plan view of the improved adjustable-width stairwell barricade shown in FIG. 1.

Referring now to FIGS. 1-3, the adjustable-width barrier 100 is preferably a planar, frameless, flexible, and generally-rectangular gate member having a width w extending between each side edge 112, 114 of the gate member and a height h extending between a top edge 114 and a bottom edge 116 of the gate member, the width w, when fully expanded, being substantially equal to or greater than the horizontal distance between the respective posts to which the barrier 100 is mounted, installed, or otherwise attached. The height h of the barrier 100 is substantially equal to or less than the vertical height of the respective posts, or at least the height of the posts below the intersection of the posts with the hand rails 30, if the posts extend above the hand rails 30, as shown by the posts 20 in FIG. 1.

A first plurality of fasteners 110 are vertically spaced along and extending from one side edge 112 of the gate member 100, each fastener having two straps adapted to engage in locking manner around one of the posts. A second plurality of fasteners 120 are vertically spaced along and extending from the other side edge 122 of the gate member 100, each fastener having two straps adapted to engage in locking manner around the corresponding post on the opposite side of the stairwell.

The adjustable-width barrier 100 is preferably made or fabricated out of a durable resilient material, such as light-weight meshed netting and reinforced nylon, with an attractive, washable woven cloth or woven fabric used as the material for the exterior surface of the adjustable-width barrier 100. The attractive washable woven cloth or woven fabric, used as the material for the exterior surface, can be of various aesthetically pleasing, decorative, ornamental designs and colors. As shown in FIG. 2, custom words (e.g., "Welcome") or a design (e.g., team athletic logo) can be prominently displayed on one or both sides of the barrier 100. In addition, stitching 132, 134, 136 can be used both for aesthetic and structural reinforcement purposes. On the back side of the barrier 100, a slot 138 provides access to the interior of the barrier between the front and back surfaces of the barrier 100. The slot 138 can be closed with a zipper or Velcro type fastener. As will be described in greater detail hereinafter, access to the interior enables insertion or removal of a plurality of struts that, when inserted within channels running vertically along the inside of the barrier, provide vertical rigidity along the height of the barrier 100.

Figure 4:
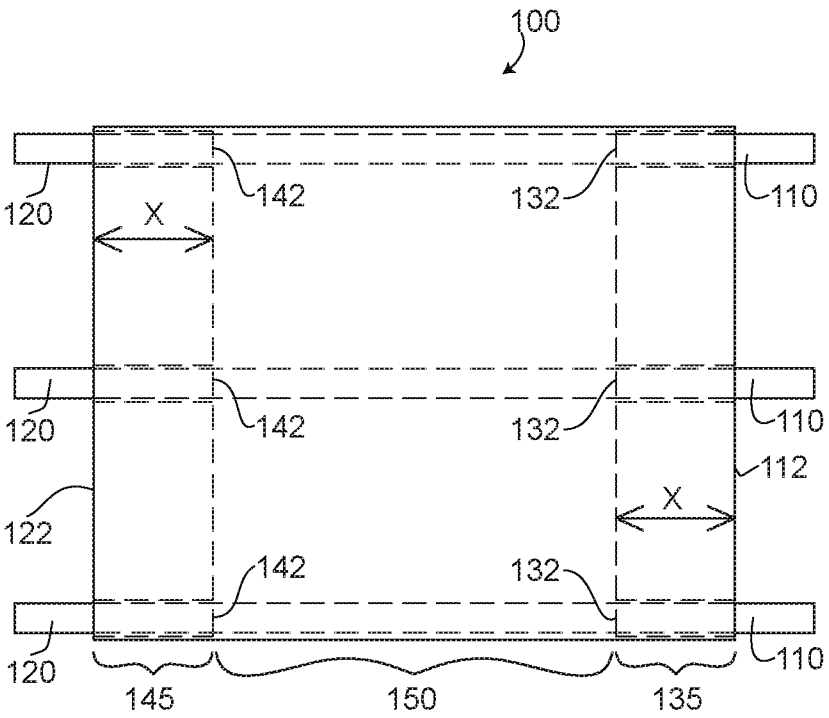
FIG. 4 illustrates a front view of the improved adjustable-width stairwell barricade shown in FIG. 1 with the lateral, internal structural support shown in dashed lines.

Turning now to FIG. 4, the lateral or horizontal structural support for the barrier 100 is described. Specifically, the configuration of the first and second plurality of fasteners 110, 120 is illustrated and described hereinafter. Preferably, each of the plurality of fasteners includes two mating straps extending away from a respective edge 112, 122 of the barrier 100, the two mating straps being configured to fasten, engage, or connect with each other after being wrapped and tightened around one of the respective posts of the stairwell. Preferably, the length of at least one of the straps is adjustable to provide lateral tension to the barrier 100.

In a preferred embodiment, the fasteners are side-release, three-point buckles; however, the fasteners can be one of many different types within the scope of the invention including, but not limited to, loop type fasteners, snap type fasteners, hook and eye type fasteners, and the like. Preferably, one of the mating straps is connected (e.g., stitched) to the edge 112, 122 of the barrier 100. The other mating strap is preferably connected (e.g., stitched) a fixed distance x within the interior of the barrier 100. The connection location is designated generally by stitch lines 132, 142. Furthermore, the other mating strap of fastener 110 is not connected to the interior of the barrier 100 between the stitch line 132 and the edge of the barrier 112, which defines a cinch or selectively-compressible portion 135 of the barrier. Similarly, the other mating strap of fastener 120, on the other side of the barrier 100, is not connected to the interior of the barrier 100 between the stitch line 142 and the edge of the barrier 122, which defines a cinch or selectively-compressible portion 145 of the barrier. To provide structural integrity and lateral tension across the barrier 100, the other mating strap of fastener 110 is connected with the other mating strap of fastener 120 and connected (e.g., stitched) substantially, continuously between stitch lines 132 and 142, which define the main body portion 150 of the barrier 100. Because the length of the other mating straps, which are stitched at connections points 132, 142 and which extend out from each side of the barrier 100, are adjustable, the barrier 100 is able to be tightened around the posts 20 so that the middle portion 150 of the barrier 100 remains taut when the mating straps are adjusted and tightened appropriately. The two side portions 135 and 145 of the barrier 100 are able to contract, cinch, or compress, as necessary, which enables the barrier 100 to be installed between posts 20 that are spaced apart a distance that is less than the width w of the barrier 100.

Preferably, the mating strap of each of the first plurality of fasteners 110 extending from one side edge 112 of the barrier 100 is connected with a corresponding mating strap of the second plurality of fasteners 120 disposed at the same vertical location and extending from the other side edge 122 of the barrier 100. The connected mating straps each define an adjustable length strap that extends laterally within the interior of the barrier 100. The plurality of fasteners 110, 120 include, at a minimum, an upper fastener that is located inside and just below the top edge 114 of the barrier and a lower fastener that is located inside and just above the bottom edge 116 of the barrier 100. Preferably, the fasteners also include one or two middle fasteners disposed between the upper and lower fasteners. Because each fastener can be independently tightened and adjusted for length, the barrier 100 is able to be installed snugly and tightly onto most any type of post or combination of posts, including decorative or ornate posts 20 that have different shapes or circumferences at different points along the height of such posts.

Preferably, a portion of each respective fastener includes a surface for non-slip and/or non-damaging engagement with the respective post of the stairwell.

Figure 5:
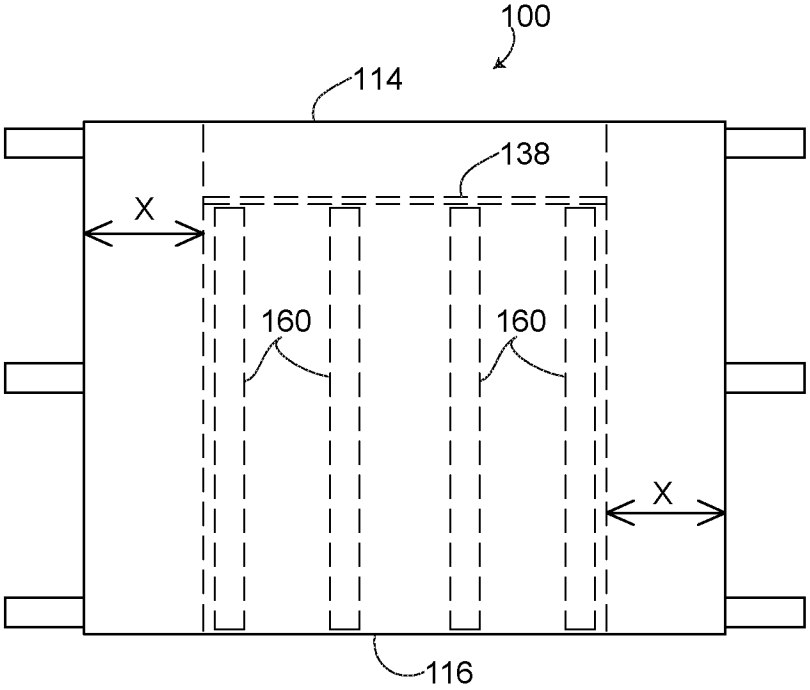
FIG. 5 illustrates a front view of the improved adjustable-width stairwell barricade shown in FIG. 1 with the vertical, internal structural support shown in dotted lines.
Figure 6:
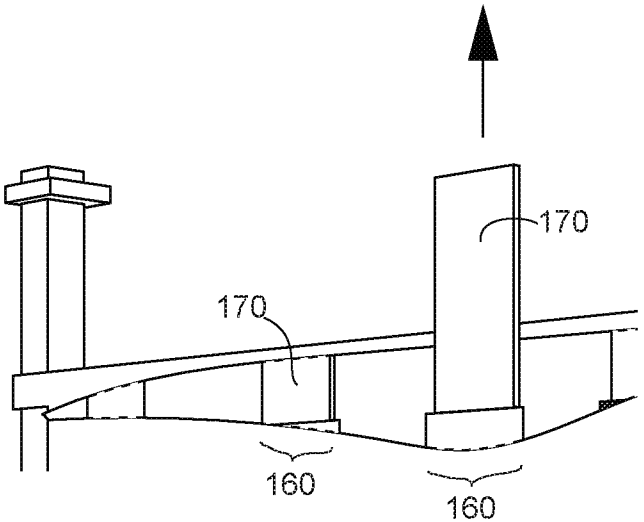
FIG. 6 illustrates a cutaway, perspective view of vertical supports illustrated in FIG. 5.

Turning now to FIGS. 5 and 6, the longitudinal or vertical structural support for the barrier 100 is described. Specifically, a plurality of vertical channels 160 extend generally between the top edge 114 and the bottom edge 116 of the barrier 100. Each of the vertical channels 160 are transversely spaced along the width of the barrier 100. Preferably, the vertical channels 160 only extend up to the slot 138 on the back side of the barrier 100. As stated previously, the slot 138 provides access to the interior between the front and back surfaces of the barrier 100. A rigid support bar or strut 170 is inserted into the top opening of each vertical channel 160, whereby the plurality of struts 170 act as structural vertical support members for the entire barrier 100. Although each vertical channel 160 only extends between the slot 138 and the bottom edge 116 of the barrier, each strut 170 preferably extends fully between the top edge 114 and the bottom edge 116 of the barrier 100. Preferably, there are two or more vertical channels 160 that extend relatively equidistantly from each edge of the barrier and from each other—with the number of vertical channel being determined based on the width of the barrier 100. In this manner, the height of the barrier 100 is rigidly maintained in non-compressible form across the entire width of the barrier 100.

Figure 7:
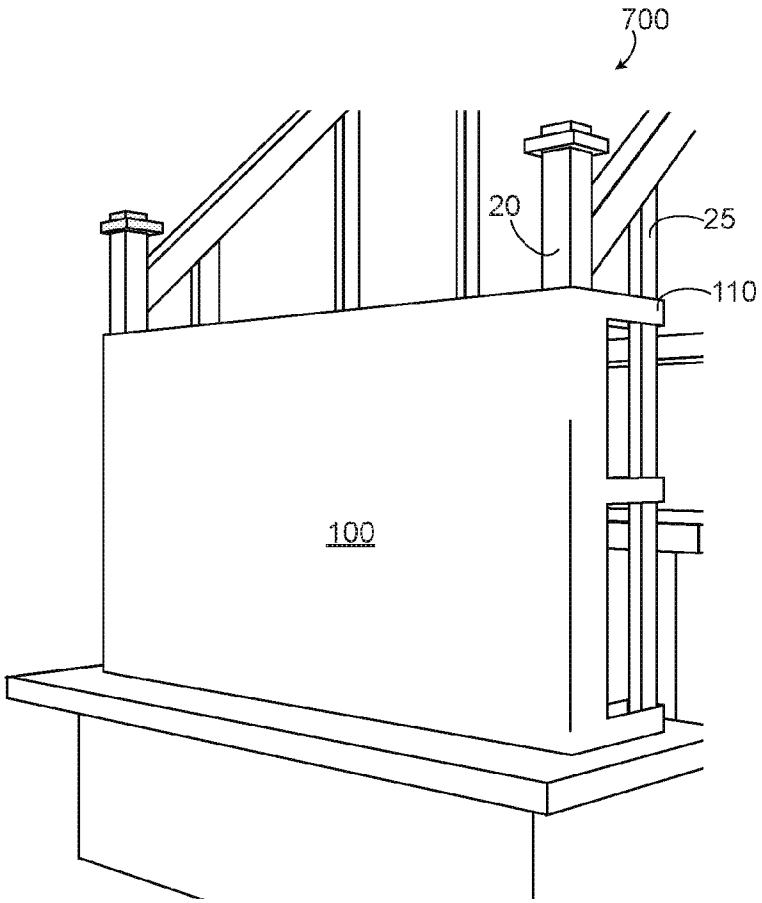
FIG. 7 illustrates a perspective view of an alternate installation of the improved adjustable-width stairwell barricade of FIG. 1.

Turning now to FIG. 7, an alternate installation 700 of the barrier 100 is illustrated. In contrast with the installation of the barrier 100 shown in FIG. 1, in which the fasteners 110, 120 are wrapped solely around the banisters 20, the alternate installation 700 illustrates that the main body of the barrier 100 can wrap around the banisters 20 but then the fasteners 110, 120 are engaged with the spindles or balusters 25.

Figure 8:
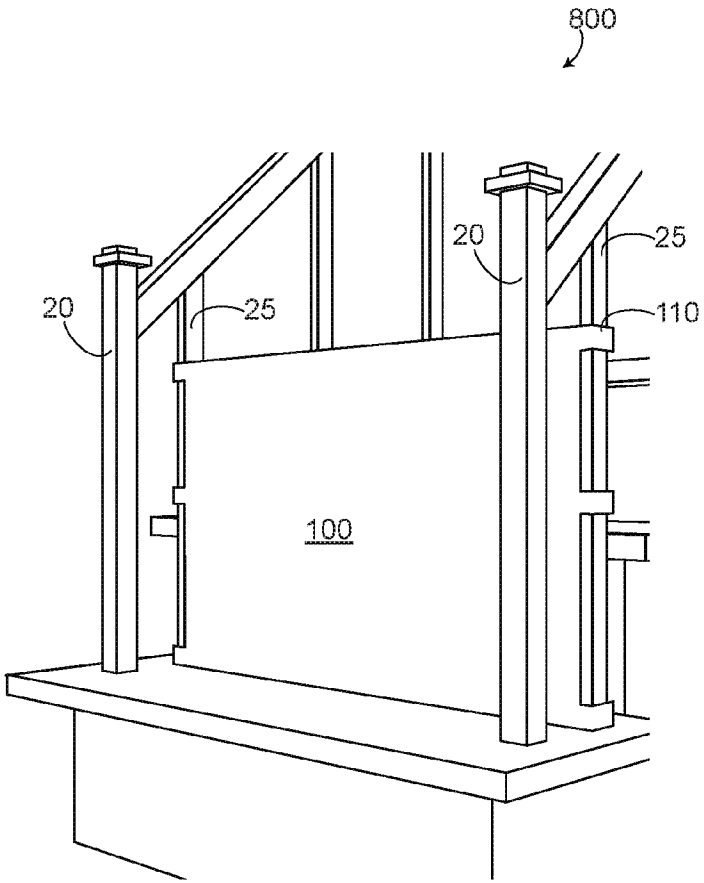
FIG. 8 illustrates a perspective view of another alternate installation of the improved adjustable-width stairwell barricade of FIG. 1.

Turning now to FIG. 8, yet another alternate installation 800 of the barrier 100 is illustrated. In contrast with the installation of the barrier 700 shown in FIG. 7, in which it is shown that the main body of the barrier 100 can be wrapped first around the banisters 20 and then attached by engaging the fasteners 110, 120 around the spindles or balusters 25, the alternate installation 800 illustrates that the fasteners 110, 120 can be wrapped solely around a pair of spindles or balusters 25 without engaging the larger posts or banisters 20.

The various installation options shown in FIGS. 1, 7, and 8 illustrate that the adjustable-width barrier 100 disclosed herein can have a wide range of widths and can be installed across stairwells of varying widths and structural designs, shapes, and styles as well.

Figure 9:
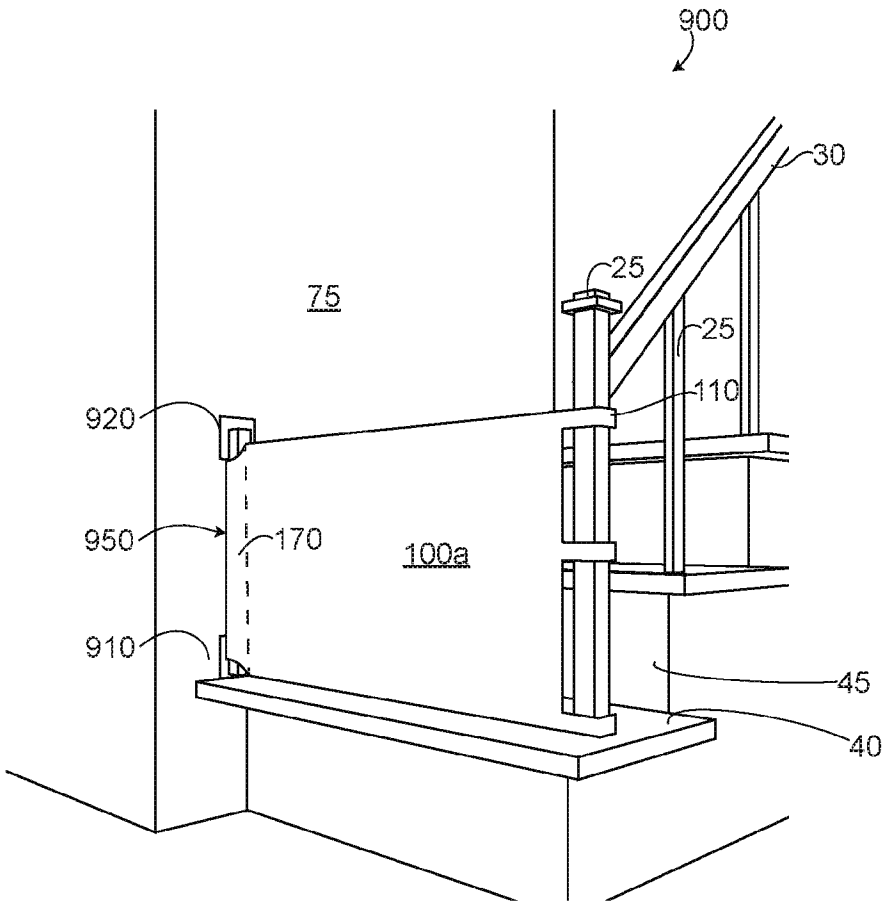
FIG. 9 illustrates a perspective view of a second embodiment of an improved adjustable-width stairwell barricade according to the present invention.
Figure 10:
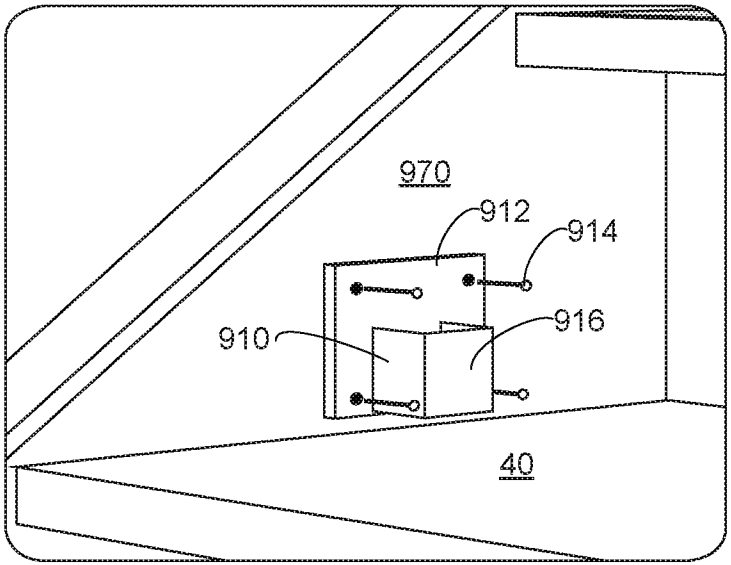
FIGS. 10-11 illustrate close-up perspective views of portions of the improved adjustable-width stairwell barricade of FIG. 9.
Figure 11:
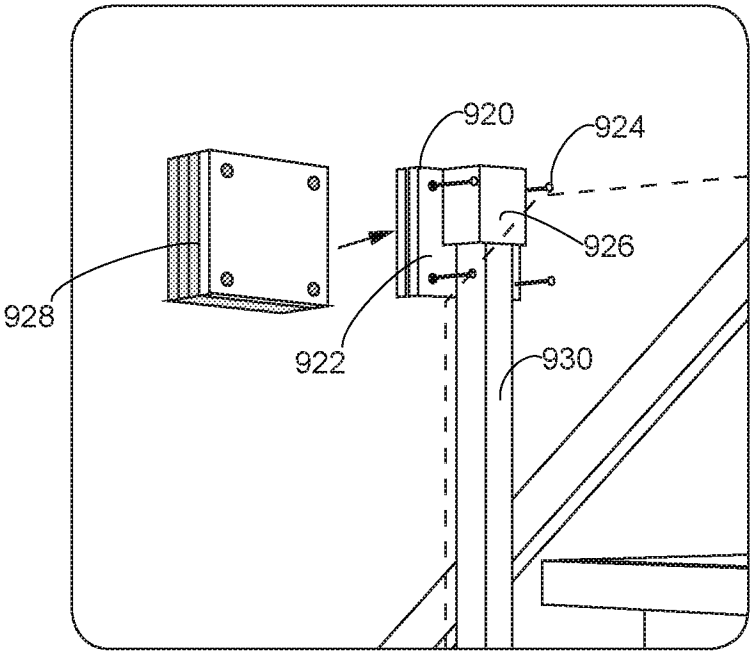

FIGS. 9-11 illustrate yet a further embodiment of the present invention in which the adjustable-width barrier **100*a* is installed between a banister 20 and a wall 75, in a wall-to-banister configuration. As with the embodiments shown in FIGS. 7 and 8, the adjustable width barrier 100*a* could be wrapped around the banister 20 and then connected using fasteners 110 to a spindle/baluster 25 or could be connected directly to the spindle/baluster 25 without wrapping around the banister 20**.

In contrast with the adjustable-width barrier 100 illustrated in FIGS. 1-8, which included a second plurality of fasteners 120, the adjustable-width barrier **100*a* has an interior channel 170 through which a rod 930 is inserted. The rod 930 is part of a wall-mounting kit 950 that also includes a bottom support bracket 910 and a top support bracket 920. With this embodiment, the adjustable-width barrier 100*a* is mounted onto the rod 930, but the width and lateral tension maintained across the barrier 100*a* is controlled by the plurality of fasteners 110 as mounted on the relevant post(s) 20, 25. Although not shown, it will be understood by those of skilled in the art that the adjustable-width barrier 100, having a second set of fasteners 120, could also be used in conjunction with the wall mounting kit 950, rather than using the adjustable-width barrier 100*a* with the interior channel 170. In such an arrangement, the second set of fasteners would be installed around the rod 930 in the same manner as they would be installed around one or more posts 20, 25**.

The bottom support bracket 910 is preferably mounted onto the stairwell molding 970 just above the floor or stair tread 40, as shown in FIG. 10. The bottom support bracket 910 includes a face plate 912 that is mounted to the stairwell molding 970 in conventional manner using screws or nails 914. The bottom support bracket 910 also includes a rod cap 916 for receiving one end of the rod 930.

The top support bracket 920 is preferably mounted onto wall 75 perpendicularly relative to the floor of stair tread 40, as shown in FIG. 11. The top support bracket 920 includes a face plate 922 that is mounted to the wall 75 in conventional manner using screws or nails 924. One to four spacer plates 928 may be inserted between the face plate 922 and the wall 75 to the extent necessary to match the thickness of the stairwell molding 970. The top support bracket 920 also includes a rod cap 926 for receiving the other end of the rod 930.

Figure 13:
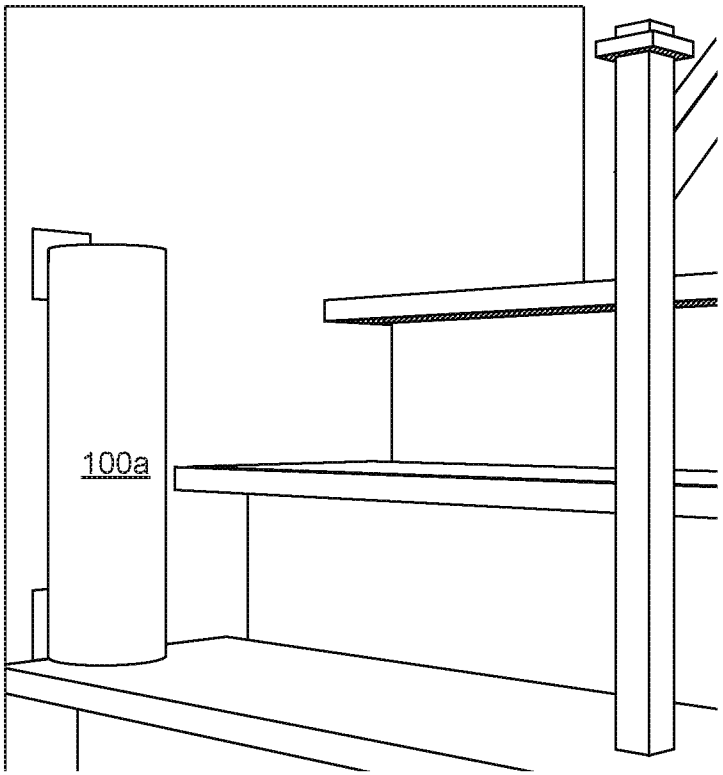
FIGS. 12-13 illustrate perspective views of the improved adjustable-width stairwell barricade of FIGS. 1 and 9, respectively, when installed in a stowed position.
Figure 12:
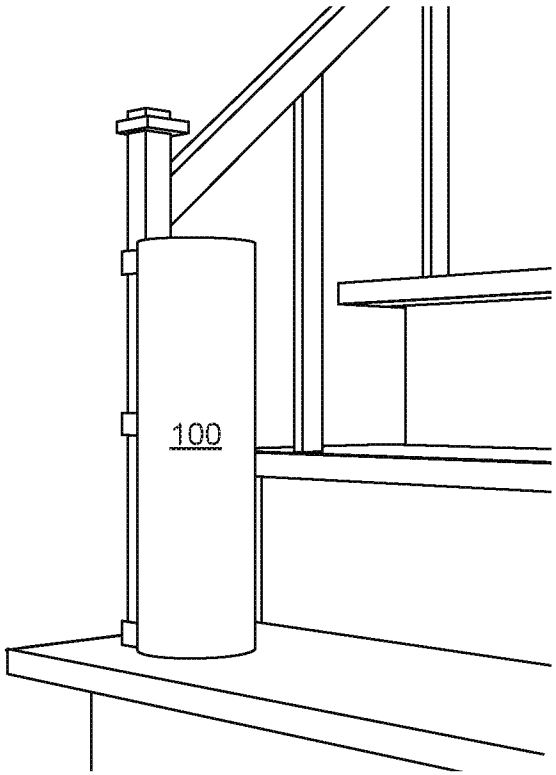

Turning now to FIGS. 12 and 13, it is shown that the adjustable-width barriers 100, **100*a* can be rolled up to one side or the other when not in use across the stairwell. The fasteners 110, 120 enable the adjustable-width barrier to roll easily and compactly to one side of the stairwell or the other. In the meantime, the struts 170** enable the adjustable-width barrier to maintain its vertical rigidity and form even when in the rolled-up position.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The above-described preferred embodiments are intended to illustrate the principles of the invention, but not to limit its scope thereto. The described preferred embodiments are not intended to be exhaustive or to limit the invention to the precise form disclosed. Rather, the appended claims should be construed broadly, to include other variants and embodiments of the invention, which will be apparent to those skilled in the art and may be made without fundamentally deviating from the spirit and scope of the invention, as illustrated in the above-described preferred embodiments.

It will be apparent to those skilled in the art that many modifications and variations may be made to embodiments of the present invention, as set forth above, without departing substantially from the principles of the present invention. All such modifications and variations are intended to be included herein within the scope of the present invention, as defined in the claims that follow.

What is claimed is:

1. An adjustable-width barricade for removable installation at a bottom of a staircase, the staircase having a plurality of steps and at least one banister positioned on one side of the staircase, the banister including a handrail and a plurality of support posts each extending between a bottom surface of the handrail and a top surface of a respective one of the plurality of steps, comprising:

a flexible, frameless, planar, and generally-rectangular barrier member having a fixed width main portion and at least one adjustable width side portion, the fixed width main portion having a mounting side edge and an opposed side edge connected to the at least one adjustable width side portion and forming a vertical junction line therebetween, the barrier member having a front surface and a back surface stitched together at least along a top edge and a bottom edge of the barrier member, the front and back surfaces defining an interior space therebetween, the barrier member having a fixed vertical height extending between the top edge and the bottom edge;

a plurality of fasteners vertically spaced along the fixed vertical height of the barrier member, each of the plurality of fasteners having a pair of straps extending from a side edge of the at least one adjustable width side portion of the barrier member, distal ends of each of the pair of straps configured to engage each other in releasable locking manner, a proximal end of one of the pair of straps connected to the side edge of the at least one adjustable width side portion, a proximal end of the other of the pair of straps extending laterally within the interior space and connected to the barrier member along the vertical junction line between the fixed width main portion and the at least one adjustable width side portion, the other of the pair of straps having an adjustable length; and a plurality of rigid, structural support members, each structural support member inserted within a respective one of a plurality of vertical channels, the respective vertical channels extending within the interior space and each having an opening near the top edge of the barrier member and a closed end near the bottom edge of the barrier member, each of the vertical channels laterally spaced along the fixed width main portion of the barrier member, wherein the height of the barrier member is rigidly maintained in non-compressible form along the width of the barrier member by the plurality of structural support members inserted within the respective vertical channels;

wherein, when the distal ends of each of the pair of straps are engaged with each other in releasable locking manner around at least one of the plurality of support posts and when the mounting side edge of the barrier member is installed on a post disposed laterally across the stairwell from the at least one of the plurality of support posts, the width of the barrier member is contracted or cinched to match the horizontal distance between the respective posts while simultaneously applying and maintaining lateral tension to the barrier member between the respective posts by tightening and adjusting the length of at least one of the plurality of fasteners engaged around the at least one of the plurality of support posts.

2. The adjustable-width barricade of claim 1, wherein the at least one of the plurality of support posts has a vertical height defined as the distance between the bottom surface of the handrail and the top surface of the respective one of the plurality of steps and wherein the fixed vertical height of the barrier member is substantially equal to or less than the vertical height of the at least one of the plurality of support posts.

3. The adjustable-width barricade of claim 2, wherein the barrier member is maintained in lateral tension between the respective posts by tightening and adjusting the length of two or more of the plurality of fasteners.

4. The adjustable-width barricade of claim 3, wherein a circumference of the at least one of the plurality of support posts varies along its vertical height and wherein the length of the two or more of the plurality of fasteners varies based on the respective circumference at locations at which each of the two or more of the plurality of fasteners engages the support post.

5. The adjustable-width barricade of claim 1, wherein a width of the barrier member is contracted or cinched within the at least one adjustable width side portion of the barrier member.

6. The adjustable-width barricade of claim 5, wherein the at least one adjustable width side portion of the barrier member is contracted or cinched based on the tension applied between the proximal end of one of the pair of straps connected to the side edge of the at least one adjustable width side portion and the proximal end of the other of the pair of straps connected to the barrier member along the vertical junction line of the barrier member.

7. The adjustable-width barricade of claim 1, wherein the mounting side edge of the barrier member includes a channel formed within the interior space of the barrier member, the channel receiving the post disposed laterally across the stairwell from the at least one of the plurality of support posts.

8. The adjustable-width barricade of claim 1, wherein the mounting side edge of the barrier member is connected to a second adjustable width side portion and forms a second vertical junction line therebetween and wherein the adjustable-width barricade further comprises a second plurality of fasteners vertically spaced along the fixed vertical height of the barrier member, each of the second plurality of fasteners having a pair of straps extending from a side edge of the second adjustable width side portion of the barrier member, distal ends of each of the pair of straps configured to engage each other in releasable locking manner, a proximal end of one of the pair of straps connected to the side edge of the second adjustable width side portion, a proximal end of the other of the pair of straps extending laterally within the interior space and connected to the barrier member along connected along the second vertical junction line between the fixed width main portion and the second adjustable width side portion, the other of the pair of straps having an adjustable length.

9. The adjustable-width barricade of claim 8, wherein a width of the barrier member is contracted or cinched within the second adjustable width side portion of the barrier member.

10. The adjustable-width barricade of claim 9, wherein the second adjustable width side portion of the barrier member is contracted or cinched based on the tension applied between the proximal end of one of the pair of straps connected to the side edge of the second adjustable width side portion and the proximal end of the other of the pair of straps connected to the barrier member along the second vertical junction line of the barrier member.

11. The adjustable-width barricade of claim 1, wherein the post disposed laterally across the stairwell from the at least one of the plurality of support posts is a wall-mounted rod and wherein the barricade is a wall-to-banister barricade.

12. The adjustable-width barricade of claim 1, wherein the post disposed laterally across the stairwell from the at least one of the plurality of support posts is a post of a second banister positioned on the other side of the staircase and wherein the barricade is a banister-to-banister barricade.

13. The adjustable-width barricade of claim 1, wherein the plurality of rigid, structural support members are accessible and removable through a slot on the back surface of the barrier member.

14. The adjustable-width barricade of claim 13, wherein the opening of each respective vertical channel is disposed below the slot on the back surface of the barrier member.

15. An adjustable-width barricade for removable installation at a bottom of a staircase, the staircase having a plurality of steps and at least one banister positioned on one side of the staircase, the banister including a handrail and a plurality of support posts each extending between a bottom surface of the handrail and a top surface of a respective one of the plurality of steps, comprising:

a flexible, frameless, planar, and generally-rectangular barrier member having a fixed width main portion and at least one adjustable width side portion, the fixed width main portion having a mounting side edge and an opposed side edge connected to the at least one adjustable width side portion and forming a vertical junction line therebetween, the barrier member having a front surface and a back surface joined together at least along a top edge and a bottom edge of the barrier member, the front and back surfaces defining an interior space therebetween, the barrier member having a fixed vertical height extending between the top edge and the bottom edge;

a plurality of fasteners vertically spaced along the fixed vertical height of the barrier member, each of the plurality of fasteners having a pair of straps extending from a side edge of the at least one adjustable width side portion of the barrier member, distal ends of each of the pair of straps configured to engage each other in releasable locking manner, a proximal end of one of the pair of straps connected to the side edge of the at least one adjustable width side portion, a proximal end of the other of the pair of straps extending laterally within the interior space and connected to the barrier member along the vertical junction line between the fixed width main portion and the at least one adjustable width side portion, the other of the pair of straps having an adjustable length; and a plurality of rigid, structural support members, each structural support member inserted within a respective one of a plurality of vertical channels, the respective vertical channels extending within the interior space and each having an opening near the top edge of the barrier member and a closed end near the bottom edge of the barrier member, each of the vertical channels laterally spaced along the fixed width main portion of the barrier member, wherein the height of the barrier member is rigidly maintained in non-compressible form along the width of the barrier member by the plurality of structural support members inserted within the respective vertical channels;

wherein the mounting side edge of the barrier member is installed on a post disposed laterally across the stairwell from a first post of the plurality of support posts, a portion of the barrier member wraps around at least a second post of the plurality of support posts, and the distal ends of each of the pair of straps are engaged with each other in releasable locking manner around at least a third post of the plurality of support posts, and wherein the barrier member is maintained in lateral tension across the stairwell by tightening and adjusting the length of at least one of the plurality of fasteners engaged around the further respective one or more of the plurality of support posts.

16. The adjustable-width barricade of claim 15, wherein the post disposed laterally across the stairwell from the first post of the plurality of support posts is a wall-mounted rod and wherein the barricade is a wall-to-banister barricade.

17. The adjustable-width barricade of claim 15, wherein the post disposed laterally across the stairwell from the first post of the plurality of support posts is a post of a second banister positioned on the other side of the staircase and wherein the barricade is a banister-to-banister barricade.

* * * * *